United States Patent [19]

Stier et al.

[11] 4,444,032

[45] Apr. 24, 1984

[54] DEVICE FOR THE UNLOCKING AND LOCKING OF DOORS

[75] Inventors: Bernhard Stier, Kelkheim-Fischbach; Klaus Rathmann, Frankfurt am Main, both of Fed. Rep. of Germany

[73] Assignee: VDO Adolf Schindling AG, Frankfurt am Main, Fed. Rep. of Germany

[21] Appl. No.: 380,501

[22] Filed: May 21, 1982

[30] Foreign Application Priority Data

May 25, 1981 [DE] Fed. Rep. of Germany ..... 3120778

[51] Int. Cl.[3] ..... E05B 65/36

[52] U.S. Cl. ..... 70/264

[58] Field of Search ..... 70/264, 262, 263; 180/289; 70/237

[56] References Cited

U.S. PATENT DOCUMENTS

| | | | |
|---|---|---|---|
| 3,105,127 | 9/1963 | Perters | 200/83 |
| 4,253,319 | 3/1981 | Feichtiger | 70/264 |
| 4,270,371 | 6/1981 | Kalk | 70/264 |

*Primary Examiner*—Robert L. Wolfe
*Attorney, Agent, or Firm*—Martin A. Farber

[57] ABSTRACT

A device for the unlocking and locking of doors has a pneumatic blocking device (41) by which, in a third switch position of a main lock (1), all secondary door locks (3) in addition to the main door lock (1) are blocked in such a manner that they cannot be opened either from the inside or from the outside and thus can now be opened only by a main key (8) for the main lock (1). A 3/2-way valve (30) for controlling the setting members (35) of the secondary door locks (3) and the blocking device (41) is so developed that it is movable into its one position by an electric setting device (29) and into the other by a pneumatic setting device (37). The pneumatic setting device (37) is controlled by the alternating pressure which is produced by the pump (21) which is so switched and controlled that each time that it starts up it definitely alternately supplies vacuum or pressure.

16 Claims, 5 Drawing Figures

DEVICE FOR THE UNLOCKING AND LOCKING OF DOORS

The present invention relates to a device for the unlocking and locking of doors, particularly the doors of automotive vehicles, in which door-locking mechanisms having pneumatic setting members are provided on individual doors and a pneumatic pump with an electric control unit is provided in a central position, the device being adapted to be controlled by at least one main door switch by means of a main-door key and the electric control unit of the pump being of such a nature that each time that it starts up it provides the setting members alternately with pressure or vacuum. One such device forms the object of U.S. Pat. No. 4,270,371 dated June 2, 1981.

In the known device, the setting members for the individual door-locking mechanisms are connected alternately with the vacuum outlet or pressure outlet of the pump upon each start of the pump by a 3/2-way valve which is automatically controlled by the system pressure. At the same time, a switch which is also actuated by the system pressure sees to it that the pump is switched off upon the completion of the unlocking or locking process. The starting of the pump is effected by a door switch.

An alternative to the embodiment in accordance with U.S. Pat. No. 4,270,371 is the device described in U.S. Pat. No. 3,105,127. Instead of a piston pump the latter embodiment has a vane pump whose direction of rotation changes upon each start so that vacuum or pressure is alternately produced at its outlet. The purpose of this pump control—precisely as in the one in accordance with U.S. Pat. No. 4,270,371—is to be able to move the setting member of each door-locking mechanism in two directions, namely into locking position or open position, with only a single line to each door-locking mechanism.

Automotive vehicles whose doors are locked are frequently broken into by breaking a window and then opening the door from the inside by means of the door handle. Thieves frequently also open automobile doors from the inside without breaking a window by pushing loops or bars through the window seal past the window pane. It is therefore necessary to secure the doors of automotive vehicles additionally so that they cannot be opened without a key either from the outside or from the inside. When driving, to be sure, all doors should for reasons of safety be capable of being opened from the inside so that in the event of an accident the passengers can leave the car without loss of time. A third requirement for automobile doors is that it be possible for the user of the car to lock himself in, so that the doors cannot be opened from the outside, for instance, so as to prevent attack at traffic lights or railway crossings. However, for reasons of safety, this locking-in of oneself should not be effected by the device which prevents the opening and closing of the doors both from the inside and from the outside since in such case the passengers would be able to get out only if the driver's doors were previously mechanically unlocked from the outside by means of the key and the other locking places thus pneumatically unlocked.

The object of the present invention is to develop a device of the aforementioned type for the unlocking and locking of doors, paticularly car doors, which makes it possible, in a particularly simple and thus economical and reliable manner, to lock the doors optionally so that they only cannot be opened from the outside or else so that they cannot be opened either from the inside or the outside.

This purpose is achieved in the manner that the setting members (35) have a pneumatically actuatable blocking device (41) and the door switch (4) has a third switch position for the control of the pump (21), which position can be actuated only with a special key, that furthermore mechanical door-lock locking is provided which is actuated in the third position of the key, and that a 3/2-way valve (29) by which the blocking device (41) is placed in pressure communication with the pump outlet in the third switch position of the door switch (4) is arranged on the outlet side of the pump.

The advantages of the invention are many. First of all, one has the same possibilities with a car provided with such a device as with a car having the traditional door locks. They can be locked in such a manner that the doors cannot be opened from the outside but can still be opened from the inside. This type of locking is advisable when traveling at night through lonely regions or unsafe sections of cities. Still another possibility of locking the door locks is provided by the invention. The door locks can be locked from the outside in such a manner that the doors cannot be opened either from the inside or from the outside. This locking position is advisable if it is intended to leave the vehicle unattended for a lengthy period of time.

In order to switch the blocking device into this third locking position a different key will advisedly be provided then for the normal locking and unlocking of the doors. The driver of such a vehicle need normally never turn this key over to anyone else, since a key for the unlocking and locking of the doors is sufficient for the automobile repair shop or for passengers. This prevents the danger that others who are temporarily in possession of a key, such as for instance the personnel of the automobile shop or gasoline stations, might possibly make a copy of the key.

Due to the fact that in accordance with the invention a 3/2-way valve which feeds the pressure from the pump either to the door-locking mechanism or the blocking device is provided on the output side of the pump, the normal rhythm of vacuum and pressure which the pump supplies can be utilized for blocking and unblocking the door-locking mechanism.

There is also the advantage that no electrical devices such as limit switches or setting devices need be provided in the individual door locks so that the device of the invention does not require any electrical wires to the individual door locks.

One advantageous embodiment of the invention resides in that the 3/2-way valve (30) is provided with an electrical or electromagnetic setting device (29) for movement into one switch position, while for movement into the other switch position it has a pneumatic setting device (37) which is movable by the vacuum in the system and the actuating pressure of which must always be greater than the actuating pressure of the blocking device (41) but less than the actuating pressure of the pneumatic setting device (18) of the switch (17). Due to these features the device of the invention is very simple in its switching technique and therefore can be manufactured at low cost. A closed electric circuit is required only for the switching of the 3/2-way valve in the one direction while for switching in the other direction the vacuum which builds up in the system is used.

In actual practice, use has been made of a device which is characterized by the fact that the 3/2-way valve (30) is a slide valve whose slide (31) is connected mechanically with a membrane of the pneumatic setting device (37) and by the fact that on the side of the membrane facing away from the slide (31) a pressure chamber (36) is provided which has a permanent pressure-fluid connection with the pressure chamber (40) of the blocking device (41) and by the fact that the slide (31) and the valve connections are developed in such a manner that a pressure line (22) coming from the pump is connected optionally either with a pressure line (32) leading to the setting member (35) of the door-locking mechanism or with a pressure-fluid line (33, 39) which leads to the blocking device (41) and simultaneously to the pressure chamber (36) of the pneumatic setting device (37) of the 3/2-way valve (30). This device has proven to be particularly simple to manufacture and reliable in operation.

In an embodiment in which the 3/2-way valve (30) has a self-releasing detent means (38) in the position in which the pump (21) is connected to the pressure chamber (40) of the blocking device (41), the switching of the 3/2-way valve into a position in which the blocking device is connected to the pump and acted on by pressure takes place abruptly. In this way the possibility of the slide of the 3/2-way valve remaining stuck in an intermediate position is prevented.

The electrical circuit of the device of the invention is made particularly simple if the switch (17) is coupled with a cutout switch (24) via which a current path leads from that contact (7) of the door switch (4) which is associated with the blocking position to the electrical or electromagnetic setting device (29) of the 3/2-way valve (30).

By connecting the electric setting device (29) of the 3/2-way valve via a diode (46) and an additional switch (47) in parallel to the motor (20) of the pump (21) in such a manner that the setting device (29) is provided with current only when the switch (47) is closed and the pump (21) is under pressure, it is clear that the basic principle of the invention can also be applied in a device which has a pump whose direction of rotation is reversible and which produces pressure or vacuum at its outlet depending on the direction of rotation.

By an embodiment in which the 3/2-way valve (30) is biased into one switch position by spring means (tension spring 51) and into the other switch position by the pneumatic setting device (37), and in which furthermore the 3/2-way valve is provided with a detent (53) and with a pawl (52) which holds it in an end position and can be disengaged by means of an electric motor (56), it is clear that the switching of the 3/2-way valve in one direction can be effected also by spring force and a detent device which is disengageable by a motor rather than electromagnetically. This type of switching is substantially faster than if the 3/2-way valve were switched directly by an electric servomotor.

The invention permits numerous possible embodiments. Preferred ones are described below and shown diagrammatically in the drawing, in which FIG. 1 is a device according to the invention for the unlocking and locking of doors, shown in a position in which the doors are unlocked;

Figure 1:
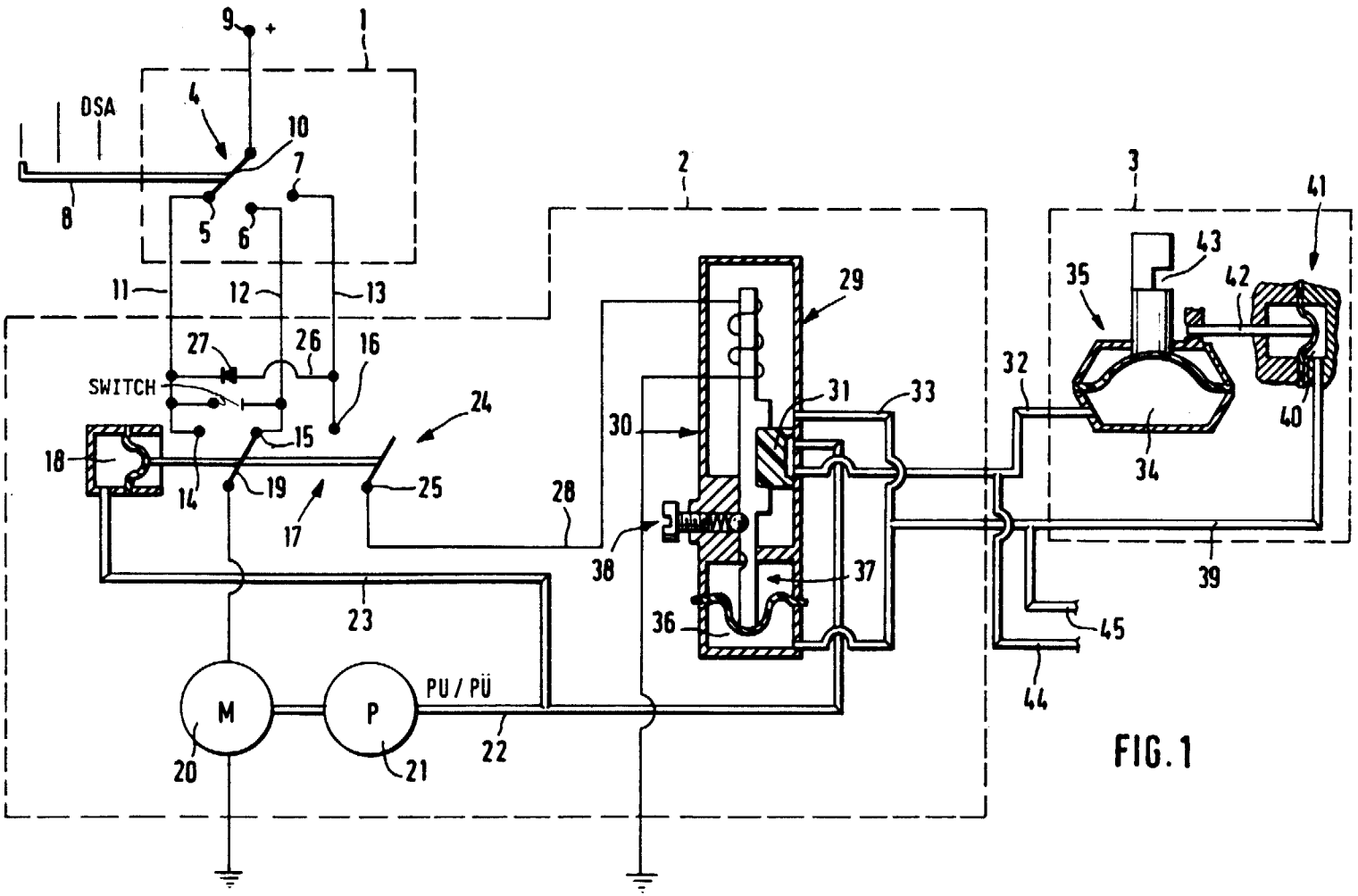

The device shown in the drawing comprises essentially three structural units each of which is indicated by dashline blocks in the drawing. These units are a main door lock 1, a central control unit 2, and secondary locks 3.

The main door lock 1 has a door switch 4 which by its contacts 5, 6 and 7 permits of three switch positions. The door switch 4 is adapted to be actuated by a main key 8 in such a manner that all three switch positions are possible. The main door lock 1 is so developed that only two switch positions can be reached by means of secondary keys not shown in the drawing. Depending on the position of the door switch 4, electrical energy passes from one pole of the car battery via a connection terminal 9 and a switch member 10 of the door switch 4 to a different one of the contacts 5, 6 or 7, depending on the position of said switch member 10. From these contacts electric wires 11, 12, 13 extend to contacts 14, 15, 16 in the central control unit 2.

The contacts 14, 15, 16 are part of a switch 17 which is dependent on the system pressure. This switch 17 has a pneumatic setting device 18. Via a switch member 19 of the switch 17 a motor 20 of a pump 21 can receive current either from the terminal 9 via the switch member 10, the contact 5, the wire 11, the contact 14 and the switch member 19 or else from the terminal 9 via the switch member 10, the contact 6, the wire 12, the contact 15 and the switch member 19.

A 3/2-way valve which is controlled automatically by the pressure behind the pump 21 and insures that upon each start of the pump 21 pressure or vacuum is built up alternately in a pressure line 22 is not shown in the drawing. Such a pump provided with a 3/2-way valve is described in U.S. Pat. No. 4,270,371, the disclosure of which is incorporated by reference herein.

From the pressure line 22 there branches off a pressure line 23 which leads to the pneumatic setting device 18 for the switch 17 which is dependent on the system pressure. This has the result that when a given vacuum is reached in the system the switch member 19 of the switch 17 is suddenly switched from the position shown in FIG. 1 by a mechanism not shown in the drawing and then connects the contact 14 with the contact 19. Similarly, at a given pressure in the system the switch 17 suddenly switches back into the position shown in FIG. 1.

The pressure-dependent switch 17 has, in addition to the switch member 19, also a cutout switch 24 by which the contact 16 can be connected with a contact 25 when the switch member 19 provides the motor 20 with current via the contact 14. An electric shunt wire 26 which contains a diode 27 makes it possible for current to flow from the line 13 to the line 11 but not in the opposite direction. The diode 27 can, however, also be dispensed with if the door switch 4 is of a different design.

From the contact 25 a wire 28 leads to an electric setting device 29 of a 3/2-way valve 30 of the central control unit 2. By means of its slide 31 this 3/2-way valve 30 switches a pressure-fluid connection from the pressure line 22 either to a pressure line 32 or to a pressure line 33. The pressure line 32 leads directly into a pressure chamber 34 of a setting member 35 of the secondary door lock 3. The pressure line 33 leads into a pressure chamber 36 of a pneumatic setting device 37 of the 3/2-way valve 30. This 3/2-way valve 30 is held by a detent device 38 in the position shown, in which the pressure line 22 is connected with the pressure line 32.

From the pressure line 33 a pressure line 39 branches off, extending into a pressure chamber 40 of a blocking device 41. The blocking device 41 has a bolt 42 which is capable of engaging in a detent notch 43 in the setting member 35, then blocking the latter.

The drawing shows only one secondary door lock 3. Of course, any desired number of secondary door locks 3 can be provided, being of identical development to the door lock 3 and being supplied with pressure or vacuum via branch lines 44, 45 from the pressure lines 32, 39.

The device described operates as follows. In the unlocked position shown in FIG. 1, all units are without current. If the door lock 4 is switched by means of the main key 8 or a secondary key so that a current connection is formed from the terminal 9 via the switch member 10 to the contact 6, the motor 20 will then receive current from the terminal 9 via the switch member 10, the contact 6, the wire 12, the contact 15 and the switch member 19. The pump 21 then starts up and produces a vacuum in the pressure line 22. This vacuum, controlled by the slide 31, passes via the pressure line 32 into the pressure chamber 34 and pulls the setting member 35 of the secondary door lock 3 back into a locking position, as shown in FIG. 2.

The vacuum in the pressure line 22 passes via the pressure line 23 also to the pneumatic setting device 18. As a result, after the pulling back of the setting member 35, the pressure-dependent switch 17 is switched so that the switch member 19 comes against the contact 14. This in its turn has the result that the motor 20 no longer receives any current from the contact 15 and disconnects. A further consequence is that the pressure within the entire system can dissipate.

Figure 2:
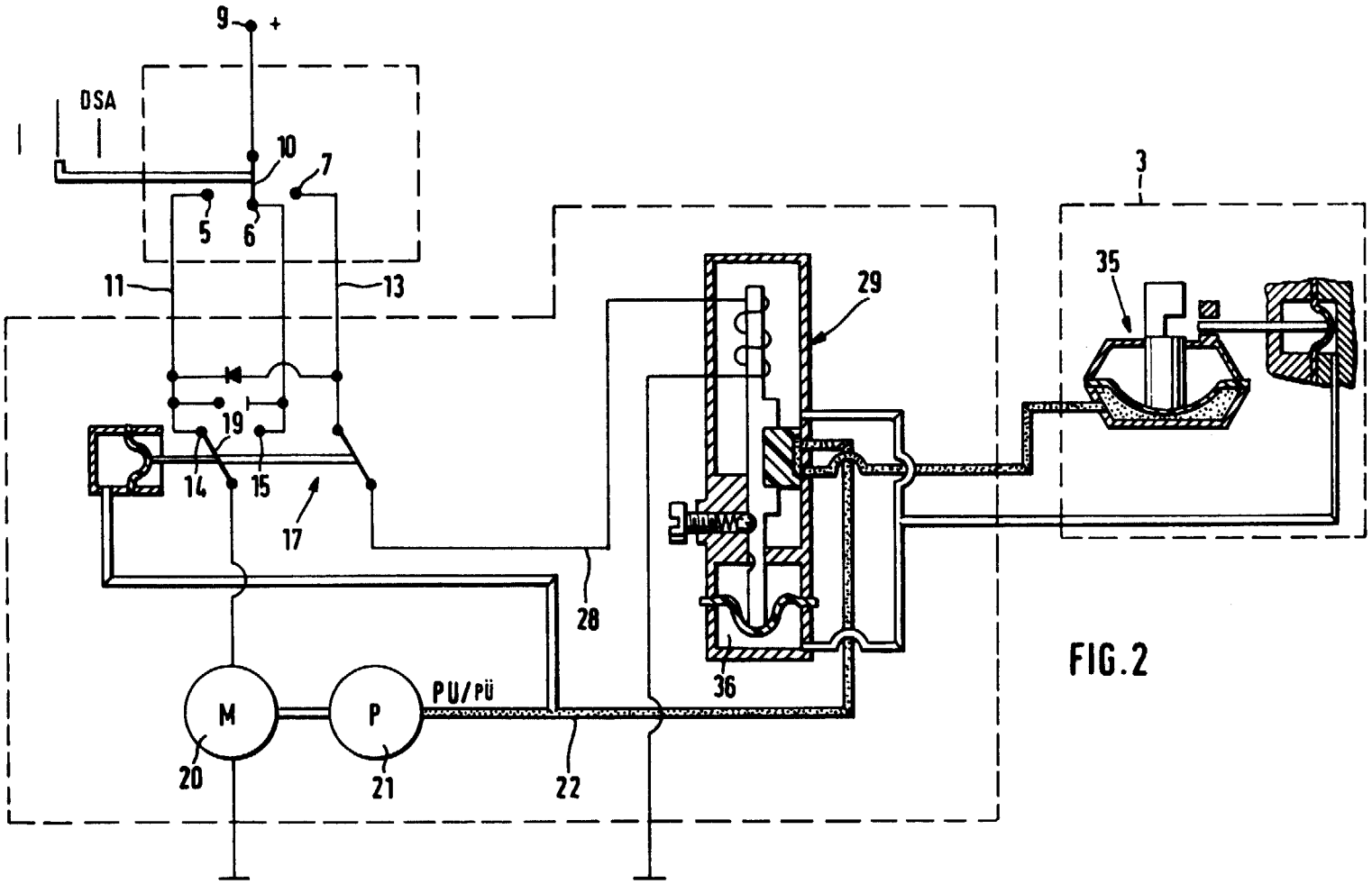
FIG. 2 is the device of FIG. 1 shown in locked condition.

Upon switching from the locked position shown in FIG. 2 back again into the unlocked position shown in FIG. 1, the motor 20 receives electrical energy from the terminal 9 via the switch member 10, the contact 5, the wire 11, the contact 14 and the switch member 19 and starts up so that pressure is fed into the pressure conduit 22. The setting member 35 again moves upward. Thereupon the switch 17 again switches into the position shown in FIG. 1. The 3/2-way valve 30 of the central control unit has not entered into operation during the locking and unlocking.

The blocking process will now be described. For this purpose the main door lock 1 must be brought into its third switch position so that the switch member 10 produces an electric connection from the connecting terminal 9 to the contact 7. This is to be possible only with the main key 8 and not with secondary keys. The path to the third switch position necessary leads over the second switch position in which the setting member 35 and the switch 17, due to vacuum, assume the position shown in FIG. 2. It may be pointed out that a motor control (not shown), e.g. disclosed as in U.S. application of Klaus Rathmann entitled the same as this application filed simultaneously herewith, the disclosure of which is hereby incorporated by reference herein, insures at all times that each command given by the door switch is carried out to completion even if further switching is effected immediately after the giving of the command and a new command is thereby given.

Figure 3:
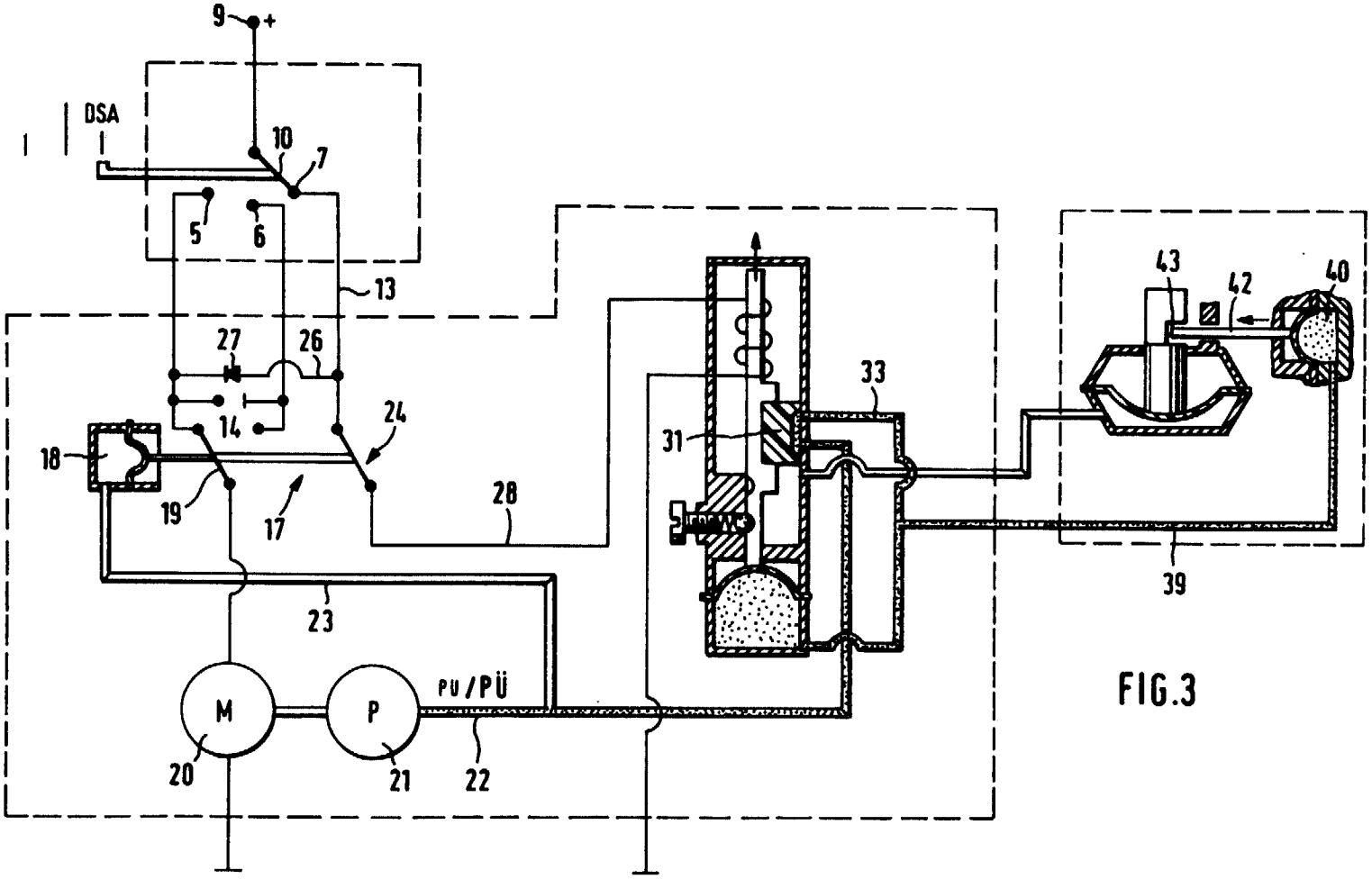
FIG. 3 is the device of FIG. 1 shown in blocked condition.

If the door switch 4 is now moved further into the third switch position shown in FIG. 3, the motor 20 thereafter receives current from the terminal 9 via the switch member 10, the contact 7, the wire 13, the shunt wire 26, the diode 27, the contact 14 and the switch member 19, so that the pump 21 starts up and produces pressure. By the moving of the door switch 4 into the third position, the electric setting device 29 has immediately received electrical energy from the terminal 9 via the switch member 10, the contact 7, the wire 13, the cutout switch 24 and the wire 28 so that the slide 31 passes into the upper position in FIG. 3. Pressure from the pump 21 therefore passes from the pressure line 22 into the pressure line 33 and from there, via the pressure line 39, into the pressure chamber 40. As a result, the bolt 42 is pushed into the notch 43 so that the setting member 35 is mechanically blocked. However, pressure also passes from the pressure line 39 into the pressure chamber 36. This, however, has no effect since the slide 31 is in any event in its upper position, as seen in the drawing.

Furthermore pressure passes via the pressure line 23 into the pneumatic setting device 18 so that the pressure-dependent switch 17 switches and comes into the position shown in FIG. 1. In this way the motor 20 is disconnected and the system can become free of pressure.

When the device is to be unblocked, the door switch 4 is switched so that it at least temporarily produces a connection from the connecting terminal 9 to the contact 6 and the motor 20 can thus start up again so that the pump 21 produces vacuum. The bolt 42 is then drawn back. Furthermore, the switch 17 is switched. Vacuum passes via the pressure line 33 into the pressure chamber 36 so that the slide 31 again comes into the position shown in FIG. 1.

If the door switch 4 is moved further into the on position, the pump 21 again produces pressure and all units assume the position shown in FIG. 1.

Figure 4:
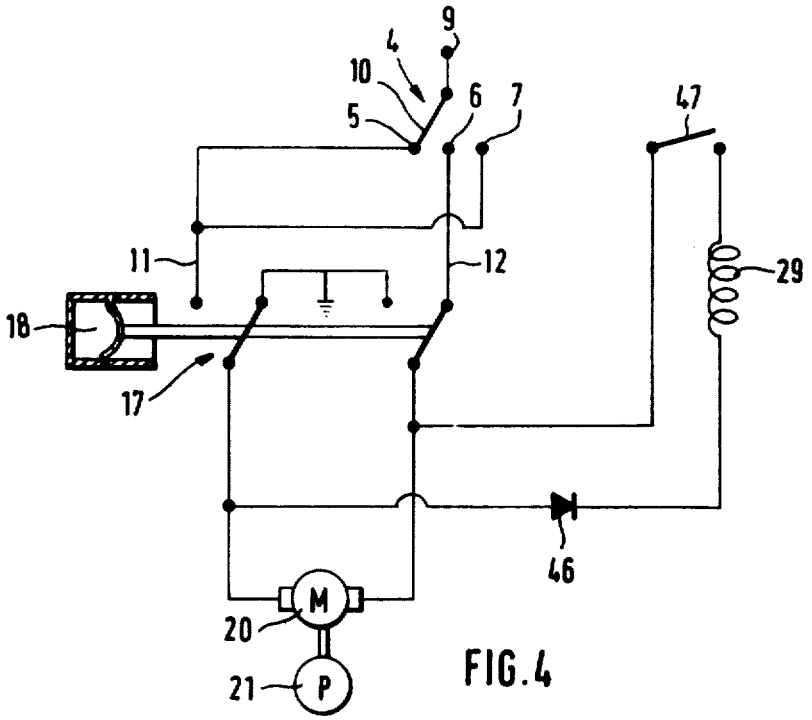
FIG. 4 shows a second embodiment of the device of the invention.

FIG. 4 shows that the basic principle of the invention can also be employed when using a pump which depending on the direction of its rotation produces pressure or vacuum at its output. Component parts which correspond to those in FIGS. 1 to 3 are shown in FIG. 4 provided with the same reference numbers.

The device shown in FIG. 4 has as its essential components, in the same way as the one previously described, a door switch 4, a pressure-dependent switch 17, a motor 20 with a pump 21, a 3/2-way valve (not shown) with an electric setting device 29 and a pneumatic setting device, also not shown. For purposes of simplification, the pressure lines and the secondary door lock with the setting member and the blocking member have also been omitted from FIG. 4.

The essential difference between the embodiment of FIG. 4 and the one previously described is that the switch 17 has no cutout switch. Instead, the electric setting device 29 is connected in parallel via diode 46 and switch 47 to the motor 20 in such a manner that the setting device 29 receives current only when the switch 47 is closed and when there is pressure at the pump 21.

The manner of operation of this embodiment follows by analogy from that previously described. The pneumatic blocking device is brought into blocking position in the manner that the switch member 10 produces a connection between the contact 7 and the connecting terminal 9 and the switch 47 is closed.

Figure 5:
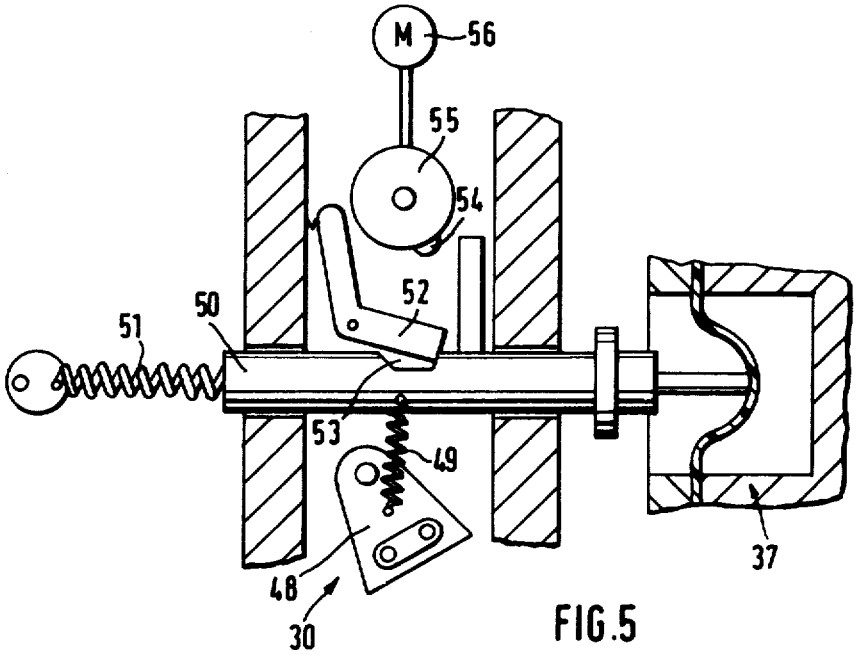
FIG. 5 is a modified embodiment of the 3/2-way valve of the device of the invention.

A modified embodiment of the 3/2-way valve 30 is shown very diagrammatically in FIG. 5. This 3/2-way valve has a control member 48 which can be moved abruptly by a tension spring 49 into each of its two switch positions. The tension spring 49 is attached to a setting member 50 which is movable in one direction by the pneumatic setting device 37 and in the other direction by a tension spring 51. By this displacement of the setting member 50, the tension spring 49 is displaced in such a manner that the control member 48 is switched in corresponding fashion.

In the position shown, the setting member 50 is prevented from passing into its other position by a pawl 52, developed as bell-crank lever, which engages in one direction, in form-lock fashion, into a notch 53 in the setting member 50. The pawl 52 is able, however, to disengage itself when it is swung in counterclockwise direction by a projection 54 on a disk 55 which is driven by an electric motor 56. The setting member 50 then rapidly moves into its other end position due to the force of the tension spring 51, the pivotal control member 48 being thereby switched via its snap-action tension spring.

For the sudden switching of the switch 17 at predetermined pressure or vacuum, respectively, a tension spring biased lever providing a snap-action after reaching the dead point (alignment of spring and lever) may be used as in U.S. Pat. No. 4,270,371.

The characteristics of the diaphragm of the pneumatic setting member 18 with respect to its actuating pressure is such that reversing switch 17 is actuated for switching off current to the motor 20 after the activation of the blocking bolt 41 (via blocking chamber 40 by means of its diaphragm) or after the actuation of the setting members 35 and the switching of the 3/2-way valve means, respectively. The pneumatic actuation of the setting device 37 likewise via its diaphragm characteristic is actuated after the blocking bolt 42 is withdrawn.

The terminology "pressure line" means a pneumatic line transmitting pressure (i.e. above-atmospheric pressure) or vacuum, respectively, and actuating pressure in the claims means vacuum or above-atmospheric pressure, respectively.

While we have disclosed embodiments of the invention, it is to be understood that these embodiments are given by example only and not in a limiting sense.

We claim:

1. In a device for the unlocking and locking of doors, particularly the doors of automotive vehicles, in which door locking mechanisms having pneumatic setting members are provided on individual doors and a pneumatic pump means with an electric control unit is provided centrally, the device being adapted to be controlled by at least one main door switch by means of a main-door key into first and second switch positions of the main door switch and the electric control unit of the pump means being such that upon each operation thereof at an operative outlet of said pump means it provides alternately above-atmospheric pressure or vacuum, the outlet of said pump means operatively communicating with said pneumatic setting members, the improvement wherein the door switch has a third switch position cooperating with means in said control unit for controlling the pump means, said door switch constitutes means for being actuated into said third switch position only with a special key, pneumatically actuatable blocking means for being actuated in the third switch position for blocking the setting members for mechanical locking of the doors, and valve means for communicating the outlet of the pump means with said blocking means with actuating pressure therefrom in the third switch position of the door switch, said valve means being operatively connected to the outlet of the pump means.

2. The device as set forth in claim 1, wherein said valve means is a 3/2-way valve means.

3. The device as set forth in claim 2, wherein said 3/2-way valve means for selectively communicating has a first connection communicating with said setting members, a second connection communicating with said outlet of the pump means, and a third connection communicating with said blocking means, said 3/2-way valve means for selectively communicating said second connection with one of the other of said connections.

4. The device as set forth in claim 2 or 3, wherein said control unit includes a switchable pneumatically actuated switch, first pneumatic setting means communicating with the outlet of said pump means for pneumatically actuating said switchable pneumatically actuated switch, electro-setting means for moving the 3/2-valve means into one switching position thereof, second pneumatic setting means for moving said 3/2-way valve means into the other switching position of said 3/2-way valve means, said second pneumatic setting means for being movable by a vacuum actuating pressure from said pump means for moving said 3/2-way valve means, said vacuum actuating pressure always is greater than an actuating pressure for actuating the blocking means but less than an actuating pressure for actuating the first pneumatic setting means for actuating the switchable pneumatically actuated switch.

5. The device as set forth in claim 4, wherein said second pneumatic setting means has a diaphragm, said 3/2-way valve means is a slide valve having a slide mechanically connected with said diaphragm of said second pneumatic setting means, said second pneumatic setting means defines a first pressure chamber on a side of the diaphragm facing away from the slide, said blocking means defines a second pressure chamber, a permanent line communicates said first pressure chamber of said second pneumatic setting means to said second pressure chamber of the blocking means, a first line communicates the outlet of said pump means with said 3/2-way valve means, a second line extends from said 3/2-way valve means to said setting members of the door-locking mechanism, a third line extends from the 3/2-way valve means to said permanent line, thereby operatively communicating with said second pressure chamber of said blocking means and simultaneously with the first pressure chamber of the second pneumatic setting means of the 3/2-way valve means via said permanent line, said second line and said third line constitute control lines, said 3/2-way valve means for selectively communicating said first line to one of said control lines in dependency on said switching positions, respectively, of the 3/2-way valve means.

6. The device as set forth in claim 2, wherein said blocking means defines an actuating chamber, a self-releasing detent means for releasable holding said 3/2-way valve means in a position thereof in which said outlet of said pump means communicates with said actuating chamber of the blocking means.

7. The device as set forth in claim 2 or 3, wherein said control unit of the pump means includes an electrical, pneumatically controlled switch comprising electro-setting means for moving the 3/2-way valve means into one switching position thereof, a cutout switch, said main door switch has a contact defining said third switch position associated with the blocking of the setting members, said pneumatically controlled switch is mechanically coupled with said cutout switch, said cutout switch constitutes means for closing a current path leading from said contact of the door switch to the electro-setting means of the 3/2-way valve means.

8. The device as set forth in claim 2, wherein said pump means is a pneumatic pump means which depending on its direction of rotation delivers the vacuum or above-atmospheric pressure at said outlet, and the pump means has a pneumatically controlled rotary direction reversing switch, electro-setting means for moving the 3/2-way valve means into one switching position thereof, said control unit includes a motor drivingly connected to said pump means, a diode and an additional switch are connected in series with said electro-setting means of said 3/2-way valve means and together in parallel to the motor of the pump means such that said electro-setting means has current only when the additional switch is closed and said pump means is pressurized.

9. The device as set forth in claim 2, further comprising spring means for biasing the 3/2-way valve means into said one switching position thereof, and pneumatic setting means for biasing said 3/2-way valve means into the other switching positioning thereof, the 3/2-way valve means is formed with a detent, pawl means cooperating with said detent for holding the 3/2-way valve means in an end position thereof, an electric motor means for disengaging said pawl means from said detent.

10. The device as set forth in claim 9, wherein said spring means is a tension spring.

11. The device as set forth in claim 4, wherein said electro-setting means is electrical.

12. The device as set forth in claim 4, wherein said electro-setting means is electromagnetic.

13. The device as set forth in claim 2, wherein said 3/2-way valve means is for operatively disconnecting said setting members from communication with the outlet of the pump mean in said third switch position.

14. The device as set forth in claim 1, wherein said valve means is for communicating the outlet of the pump means with said blocking means with above-atmospheric actuating pressure therefrom in the third switch position of the door switch.

15. The device as set forth in claim 1, wherein said valve means is for communicating the outlet of the pump means with said blocking means with vacuum pressure in the second switch position of the door switch.

16. The device as set forth in claim 1, wherein said control unit includes a pneumatically actuated reversing switch means upon actuation for switching off current to said pump means, means for continuously operating said pump means upon said main door switch reaching any of said switch positions until said pneumatically actuated reversing switch means switches off said pump means, said pneumatically actuated reversing switch means for being actuated after actuation of said setting members and said blocking means, respectively, via said pump means.

* * * * *